United States Patent [19]

Chastain

[11] Patent Number: 4,818,839

[45] Date of Patent: Apr. 4, 1989

[54] PROCESS FOR TREATING THE METAL EDGE OF A SKI

[75] Inventor: William P. Chastain, Tacoma, Wash.

[73] Assignee: K-2 Corporaton, Vashon Island, Wash.

[21] Appl. No.: 93,082

[22] Filed: Sep. 1, 1987

Related U.S. Application Data

[63] Continuation of Ser. No. 744,046, Jun. 12, 1985, abandoned.

[51] Int. Cl.[4] ..... B23K 9/04

[52] U.S. Cl. ..... 219/76.14; 219/81

[58] Field of Search ..... 219/76.13, 76.14, 76.17, 219/76.1, 77, 81; 280/608, 609

[56] References Cited

U.S. PATENT DOCUMENTS

| | | | |
|---|---|---|---|
| 1,460,137 | 6/1923 | Myers | 219/76.17 |
| 2,964,420 | 12/1960 | Poorman et al. | 428/328 |
| 3,028,478 | 4/1962 | Belopitov | 219/76 |
| 3,360,630 | 12/1967 | Blaszkowski | 219/76.13 |
| 3,419,415 | 12/1968 | Dittrich | 427/423 |
| 3,446,932 | 5/1969 | Belopitor | 219/76.13 |
| 3,459,917 | 8/1969 | Felts | 219/76.13 |
| 3,523,171 | 8/1970 | Belopitov | 219/76 |
| 3,617,358 | 11/1971 | Dittrich | 427/423 |
| 3,637,226 | 1/1972 | Simon | 280/11.13 V |
| 3,719,519 | 3/1973 | Perugini | 428/557 |
| 3,918,728 | 11/1975 | Stugger et al. | 280/11.13 E |
| 3,918,728 | 11/1975 | Stugger et al. | 280/11.13 E |
| 4,083,577 | 4/1978 | Ford | 280/609 |

FOREIGN PATENT DOCUMENTS

| | | |
|---|---|---|
| 1941660 | 6/1960 | Fed. Rep. of Germany . |
| 1563297 | 3/1969 | France . |
| 45-15697 | 6/1970 | Japan . |

*Primary Examiner*—Teresa J. Walberg

*Attorney, Agent, or Firm*—Christensen, O'Connor, Johnson & Kindness

[57] ABSTRACT

A process of depositing carbide on the metal edge of a ski including creating an electrical voltage differential between a relatively moving carbide electrode and the metal edge of a ski spaced therefrom such that an electrical arc passes from the electrode to the metal ski edge across the space. The electrical arc carries carbide from the electrode and deposits it on the metal ski edge. The product formed by this process and apparatus for carrying out the process.

41 Claims, 6 Drawing Sheets

Fig. 4.
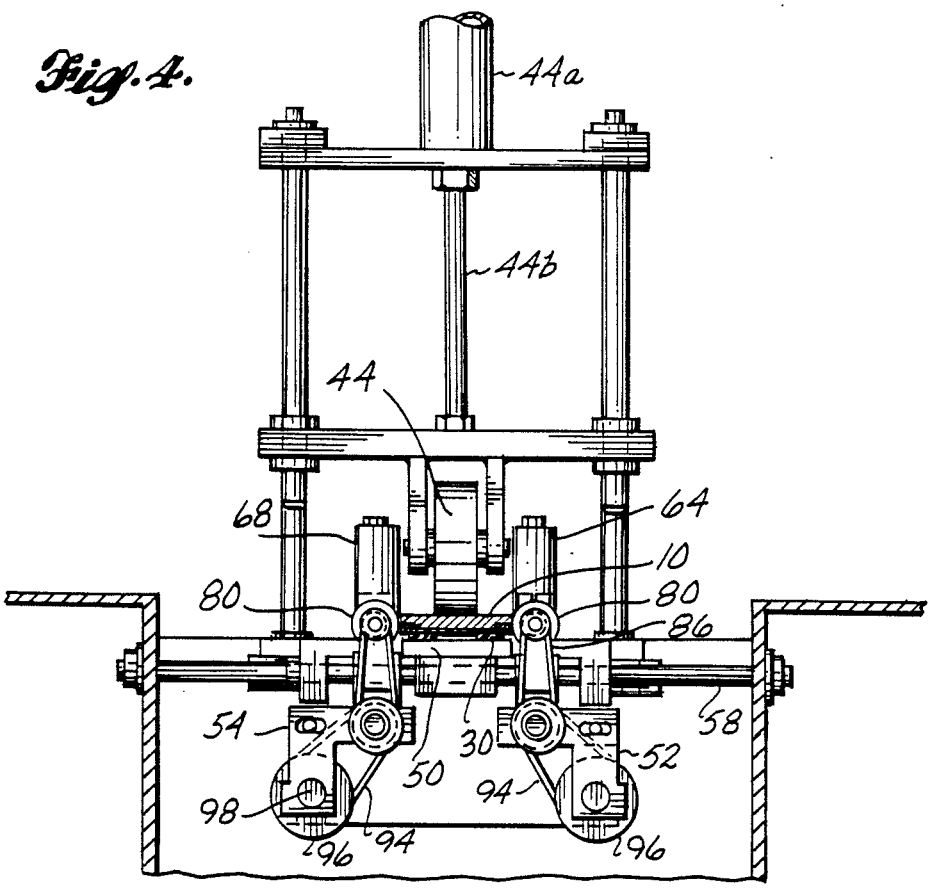
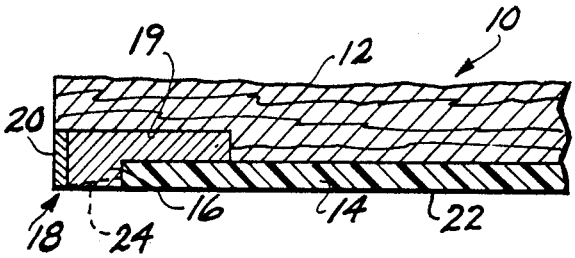
Fig. 1.

Fig. 5.
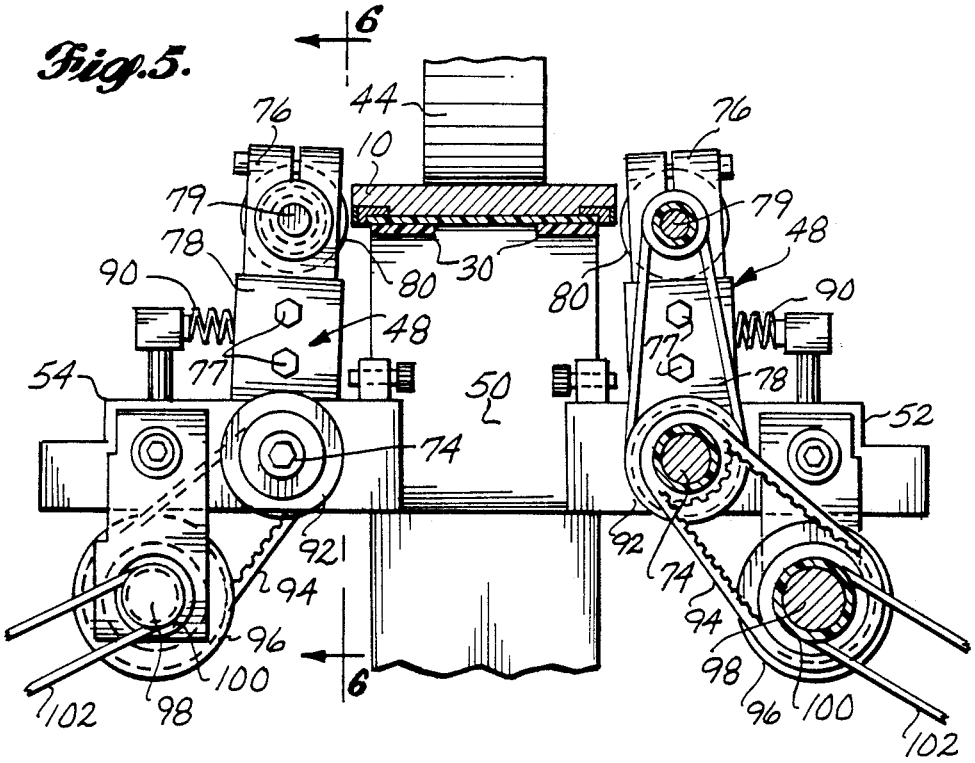
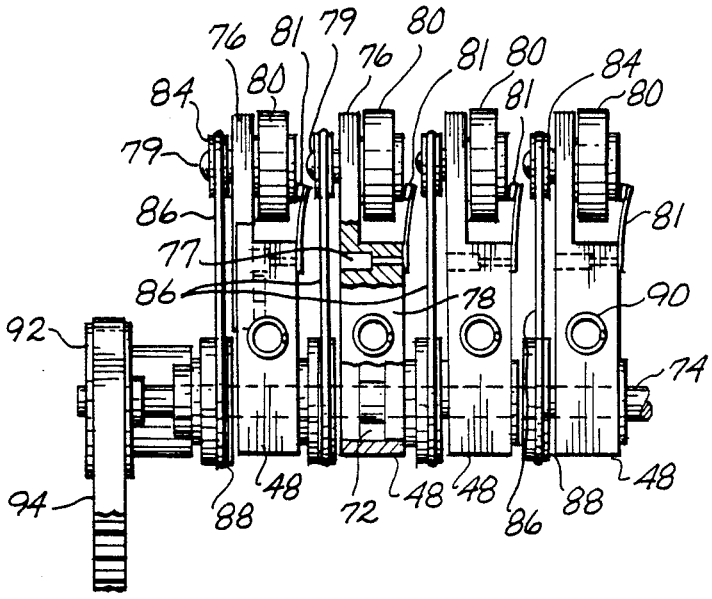
Fig. 6.

PROCESS FOR TREATING THE METAL EDGE OF A SKI

This application is a continuation application based on prior co-pending application Ser. No. 744,046 filed June 12, 1985, now abandoned.

TECHNICAL FIELD

The present invention relates to snow skis of the type which include metal edges positioned at the periphery of the bottom or running surface of a ski and, more particularly, to a process for treating the metal ski edge after it has been mounted in place on a ski. The process includes grounding the metal ski edge and then moving the ski past an electrically charged electrode spaced from the ski edge such that an electrical arc passes from the electrode to the metal ski edge carrying with it material from the electrode and melting and depositing it on the ski edge. In one embodiment, the electrode is formed, in part, of carbide and portions of the carbide electrode are carried by the electrical arc to the metal ski edge to form a hard coating thereon. Apparatus for carrying out this process is also disclosed.

BACKGROUND OF THE INVENTION

Snow skis may be considered to be comprised of a body portion and a base or running surface portion. Typically, the body portion is formed of a composite of fiberglass impregnated with epoxy resin, a core material of foam, wood or honeycomb metal, and other materials which may be included in the ski body to control ski vibration or otherwise affect ski performance. The present invention also has application to skis whose body portion is formed in any other way. The base or running surface portion of the ski is typically comprised of a layer of petroleum based material such as polyethylene, high molecular weight sintered material, or P-tex, ® all of which materials are characterized by the ability to run freely on a snow surface rather than sticking to it. The lateral outer portions of the base surface are provided with metal edges which extend from tip to tail on both sides of the ski and, when sharp, provide an edge which allows a user to carve turns and check his speed, particularly on hard packed snow or icy surfaces. Metal ski edges typically include a rectangular portion having a surface exposed on the bottom, or running surface of the ski a surface exposed along the lower portion of the lateral side of the ski, and an arm extending from the rectangular portion into the body of the ski above the slippery base member to anchor the metal ski edge in place. Metal ski edges may be continuous or "cracked" to increase their flexibility, or in some instances, particularly in older skis, may be formed of a plurality of longitudinally adjacent separate metal members.

In the past, ski edges have been tuned or sharpened by grinding, filing or sanding in such a manner that the outer, lower corner of the ski edge defines an angle of approximately 90°. With use, however, the corners of metal ski edges become rounded or dull thus reducing the skier's ability to control the movement of his skis over the surface of the snow, and particularly over icy or hard packed snow. Forming ski edges entirely out of extremely hard, brittle steel has not proven to be a solution to the wear problem, both due to difficulty of manufacture and because the continuous flexing of a ski edge during use causes brittle material to crack.

It is known to attempt to reduce the rapid dulling of a metal ski edge by coating the surface of the metal ski edge, or a portion thereof, with a harder material. For example, French patent disclosure No. 1,563,297 discloses placement of a thin layer of tungsten carbide or aluminum oxide on either the side or bottom surface of a metal ski edge. The disclosed method of applying the material is flame spraying, a process wherein a flame, such as from a blow torch, is directed against the surface to be coated, and particles of the material to be applied are then directed into the flame and carried against and bonded to the metal ski edge surface by the movement of the flame.

Stugger et al. U.S. Pat. No. 3,918,728 discloses the use of what is termed "cold process" flame spraying to apply carbide particles of a particular size range, i.e., between −100 mesh and 15 microns, to the lateral surface of a metal ski edge in a layer of from 1–10 mils thickness to roughen the surface and make it abrasive.

Applicant has found that the use of flame spraying is not an effective or commercially satisfactory technique for use with skis into which the metal edge has already been incorporated in that it is difficult to prevent the flame sprayed material from being deposited on the ski as well as on the metal ski edge. In the present invention, the carbide is actually drawn toward the metal ski edge during the electrical discharge as will be described hereafter. Flame spraying of metal edges prior to installation on a ski also creates complications related to sanding and finishing the bottom of the ski surface.

It is also known generally to deposit precious metal on a substrate by sparks discharge. Belopitov, U.S. Pat. Nos. 3,028,478; 3,446,932 and 3,523,171 all disclose apparatus for accomplishing this. The U.S. Pat. Nos. 3,446,932 and 3,523,171 patents disclose apparatus wherein an anode in the shape of a rapidly rotating thin disc or brush are charged and brought into pressure contact with a cathode material to be coated.

The present invention provides a unique continuous coating method and apparatus for treating a metal ski edge after it is mounted in a ski whereby a very thin, melted coating of hard material is deposited electrically on the lateral sides of the metal ski edge. The method and apparatus deposits a relatively smooth melted coating of material such as tungsten carbide without undue heating, discoloring or otherwise damaging any portion of the ski adjacent the metal ski edge. In particular the method and apparatus deposits a hard melted coating without the roughness characterized by the prior flame spray coating techniques wherein distinct particles were deposited on the metal ski edge.

SUMMARY OF THE INVENTION

A ski having a metal ski edge is positioned on a conveyer and carried along a path past one or more electrodes formed in part of a hard material such as tungsten carbide. The metal edge of the ski is grounded or otherwise held at an electrical potential lower than that of the electrodes such that an electrical arc passes from the electrodes to the metal ski edge as the ski edge moves thereby. The electrical arc carries carbide material from the electrode and deposits it on only the lateral side of the portion of the metal ski edge which is to be coated.

In one aspect of the invention, the ski placed on the conveyer trips a timing switch which causes a plurality of hold-down rollers to press upon the top of the ski to remove the vertical camber from the ski during treatment. The electrodes are comprised of a plurality of rapidly spinning wheels pivotally mounted upon carrying heads which are positioned to be moved inwardly and outwardly with respect to the side edges of the ski and to thus move the electrodes to a position adjacent to, but spaced from, the metal ski edge. Guide rollers positioned on the fore-and-aft edges of the carrying heads contact the side edges of the ski both to maintain the spacing of the electrodes from the metal ski edges to accommodate the side curvature of the ski, and to ground the metal ski edge.

The rotating metal electrodes are spring-biased toward the metal ski edge to ensure that an electrical arc will occur when the distance of the wheel from the ski edge and the electrical potential difference between the electrode and the metal ski edge result in arcing conditions. After moving toward the ski and arcing, the spinning electrode wheel rebounds either from the force of the electrical discharge or from contact with the ski edge, and is again spring-biased toward the metal ski edge to repeatedly produce a series of electrical arcs and consequent deposits of hard material as the ski passes the electrode. Arcing may also occur when the electrode wheel is moving away from the ski edge if arcing conditions of charge and spacing occur. The placement of a plurality of electrodes on each side of the ski, control of the speed of travel of the ski, spring tension, direction of rotation of the electrodes, and possible modification of other factors, allows the thickness of the layer of hardening material carried from the electrodes to the metal ski edge to be controlled. In general, however, the coating deposited by the present invention is less than 1 mil in thickness.

The electrical deposition process carried out in accord with the method and apparatus disclosed herein produces a very thin surface coating of hard material near the lower edge of the lateral side of the metal ski edge. The deposited material has a melted appearance rather than being formed of discrete particles. This electrical deposition process does not excessively heat, disfigure or otherwise adversely affect plastic, resin or fiberglass materials adjacent to the metal ski edge, nor require any additional cosmetic treatment to "clean up" any side effects or residue of this deposition process.

BRIEF DESCRIPTION OF THE DRAWINGS

The details of a typical embodiment of the present invention will be described in connection with the accompanying drawings, in which:

FIG. 1 is a partial cross-sectional view of a snow ski;

FIG. 4 is a partial sectional view of the apparatus taken along lines 4—4 of FIG. 2;

FIG. 5 is a partial end view of the apparatus showing the carbide wheel electrodes adjacent the metal edge of a ski;

FIG. 6 is a partial elevation view taken along lines 6-6 of FIG. 5;

DETAILED DESCRIPTION

Figure 2:
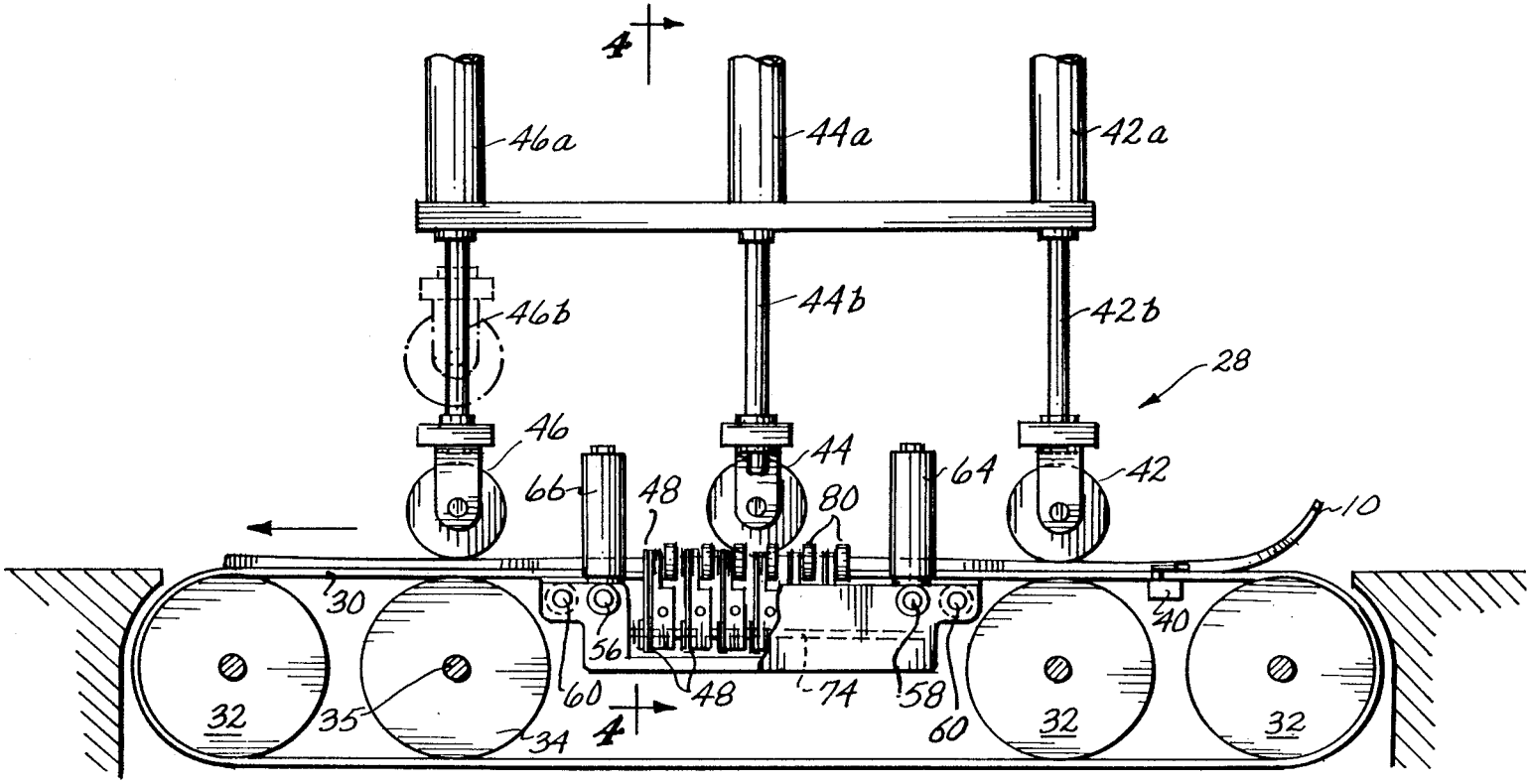
FIG. 2 is a partial side elevation view of an apparatus for carrying out the method of the present invention.

FIG. 1 illustrates a portion of a typical ski 10 including a body portion 12 which may be formed of any material conventionally used for ski construction or a combination of such materials and a base member 14 positioned therebelow. The base member may be formed of any suitable material having the basic characteristic of being freely slidable over snow. Also shown is a cross-sectional view of a metal ski edge 16, typically steel, shaped to comprise a generally rectangular portion positioned such that two of its side surfaces are exposed to form the corner of the ski 18 and also including an arm portion 19 extending into the ski above the base member to anchor the metal edge in place.

As shown, the corner 18 of the metal ski edge is shaped in the form of a right angle thus providing a sharp corner which is readily suited for carving hard packed snow and ice which is encountered while skiing. It is well known that metal ski edges having a sharp corner 18 provide good control to skiers and are highly desirable. Unfortunately, in use, such metal edges tend to become rounded and worn from repeated contact with snow, ice, rocks and other materials which may be encountered while skiing on a mountain. The rounding of the corner 18, which is commonly referred to as the "dulling" of the ski edge, significantly reduces a user's ability to control the motion of the skis, and consequently, the skier's own motion and speed over the snow.

Typically, when ski edges become dulled they are resharpened by grinding, filing or sanding the metal edges to recreate the approximate 90° angle at corner 18. It will be understood that the sharpness of the ski edge can be increased by forming the angle at corner 18 at somewhat less than 90°. Current techniques for sharpening skis are both labor intensive and difficult for most skiers to perform correctly. Thus, ski edge sharpening is usually performed by ski shops at some cost to the skier.

The method of the present invention eliminates or substantially reduces the need for repeated sharpening of metal ski edges by treating the metal ski edge in a manner such that a thin layer of a hard material is deposited on at least a portion of the side surface of the metal ski edge to prevent or reduce the wear of this surface of the ski edge. In FIG. 1, this deposited layer is exaggeratedly shown at 20 as having substantial thickness and extending completely over the lateral side of the metal ski edge, but it will be understood that in most instances the hard coating is very thin, i.e., less than 1 mil in thickness and typically in the range of 0.0001 to 0.0005 inches and will be deposited only on the lower portion of the side surface adjacent corner 18. The positioning of the hard surface 20 on the lateral side of the metal ski edge 16 prevents the rounding of corner 18 during use of the ski and it will be understood that the fact that, in accord with the disclosed method, the bottom surface 22 of the metal ski edge is not coated with the hard material, will allow it to continue to wear with use thus producing a desirable, less than 90°, angle at corner 18. This additional wear and the consequent sharpening of the ski edge is illustrated by dashed line 24 in FIG. 1. In this way, a ski edge treated in accord with the disclosed method creates a self-sharpening ski edge.

The method of the present invention broadly comprises creating relative longitudinal movement between the metal ski edge maintained at a first electrical potential level and one or more electrodes positioned adjacent the ski edge and maintained at a second higher electrical potential level. The electrodes are themselves formed, at least in part, of a hard material such as tungsten carbide. The charged electrodes move toward and away from the metal ski edge to repeatedly produce an electrical arc which passes from the electrode to the lateral side of the metal ski edge and carries with it a portion of the tungsten carbide electrode and deposits it upon the lateral surface of the metal ski edge. The mechanism of deposition is not fully understood. However, micrographic examination of treated edges indicates the formation of untempered martensite on the surface of the ski edge, thus indicating that the steel edge surface has been heated to in excess of 1400° F. and "self-quenched." In one test sample, the body of the ski edge was found to have a hardness of 47HRC, while the treated surface had a hardness of 63HRC in the heat-affected zone. In accord with the present method, a very thin layer of a material such as carbide may be selectively positioned on surface 20 adjacent the corner 18 of the ski edge in a rapid manner and without overheating, discoloring or otherwise damaging in any way, either the body or base of the ski on which the metal ski edge is mounted.

In accord with one process employing tungsten carbide electrodes, a layer of carbide having a thickness of 0.0003 inches was deposited in less than 10 seconds on the lateral sides of a metal ski edge adjacent the wear-prone corner 18 without any damage or disfiguration of the completed fiberglass ski. The method of the present invention can thus be carried out as the last, or near last, step in a manufacturing process to produce a ski having an improved metal edge which may never need to be sharpened during the life of the ski. If, however, the ski edge does become dulled due to extreme use and consequent wearing off of the deposited carbide, the ski edge may be sharpened and readily retreated to again produce a ski edge which will remain sharp for a very extended period.

Figure 3:
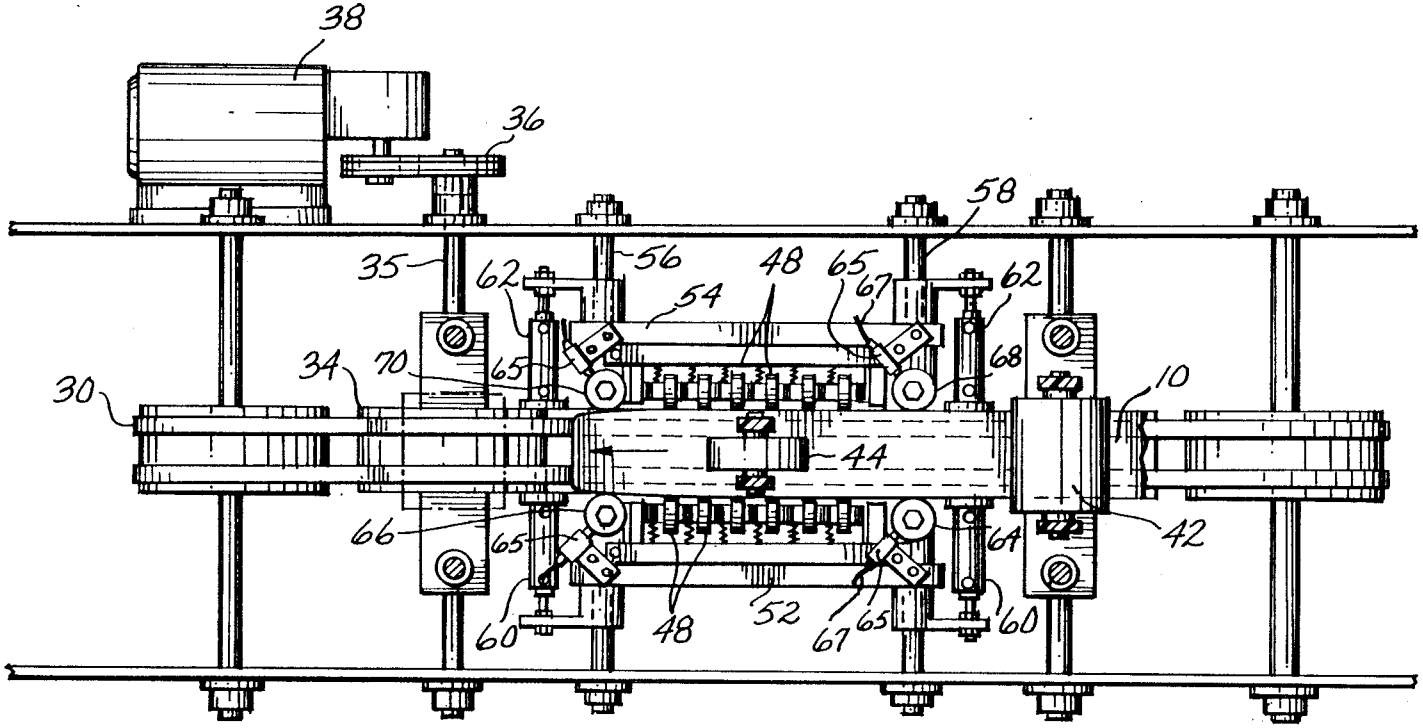
FIG. 3 is a partial plan view of the apparatus of FIG. 2.

Referring now to FIGS. 2 and 3, an apparatus 28 is disclosed which has been found suitable for carrying out the method of the present invention. A ski 10 is shown being conveyed tail first on a pair of conveyor belts 30 which ride on guide pulleys 32 and are driven by drive pulley 34. As shown in FIG. 3, drive pulley 34 is mounted on axle 35 and is driven by conventional chain and sprocket or belt and pulley means 36 which are powered by a conventional electric gearhead motor 38.

As illustrated in FIG. 2, ski 10 is placed tail first upon conveyors 30 and is carried over a limit switch 40 positioned between pulleys 32. The tripping of limit switch 40 by the ski actuates a timing sequence (see discussion of FIG. 8 below) governing the movement of pneumatically actuated downhold rollers 42, 44 and 46. The function of these rollers is to remove the vertical camber from ski 10 while material is being deposited on the metal edges of the ski. As discussed heretofore, it is important that the deposited material be placed adjacent the lower portion of the lateral side of the metal ski edge, i.e., near corner 18, if wear reduction is to be effective. Since the vertical camber of skis varies, removal of the camber by means of downhold rollers 42, 44 and 46 fixes the location of the ski edge during treatment and allows the hard material to be deposited precisely in a desired location.

After ski 10 passes over limit switch 40, pneumatic cylinder **42*a* is actuated to drive cylinder shaft 42*b* which carries downhold roller 42 downward to bear upon the tail of ski 10. Likewise, the electrical timing sequence activated by switch 40 causes cylinder 44*a* to drive cylinder shaft 44*b* carrying roller 44 downwardly against ski 10 as it passes therebeneath. This process is repeated by cylinder 46*a* and cylinder shaft 46*b* as the tail of ski 10 passes therebeneath. As shown in FIG. 3, downhold rollers 42 and 46 have a width somewhat greater than the width of ski 10, while downhold roller 44 is of a lesser width such that it presses only upon a center section of ski 10, thus avoiding any possible contact with the treating electrodes 48 shown positioned adjacent the sides of ski 10 in FIG. 3. When the shovel of ski 10 passes over switch 40** to release it, a timing sequence is again set up to cause the rollers to rise sequentially to release the ski and thus avoid contact with the upwardly extending shovel.

Referring additionally to FIG. 4, it will be seen that ski 10 and conveyor belts 30 ride upon a fixed support member 50 in the center portion of the machine between guide pulley 32 and drive pulley 34. Laterally adjacent fixed member 50 are a pair of electrode carrying heads 52 and 54 which are slidably mounted upon transversely extending shafts 56 and 58. Pairs of pneumatic cylinders and pistons 60, 62 are mounted to move electrode carrying heads 52 and 54 toward and away from the edges of ski 10. In one embodiment of the present invention, limit switch 40 not only controls the upward and downward movement of downhold rollers 42, 44 and 46, but also controls the inward and outward movement of electrode carrying heads 52 and 54 such that the electrodes are moved adjacent the metal edges of ski 10 when that portion of the metal edge of the ski which is to be treated passes adjacent electrodes 48.

Pairs of guide rollers 64, 66, 68, 70 are mounted on the longitudinal ends of electrode carrying heads 52 and 54, adjacent the laterally inward edge of the carrying heads. Guide rollers 64 and 68 contact the lateral edges of ski 10 when pairs of cylinders and pistons 60 and 62 move the electrode carrying heads inward toward ski 10 shortly after the tail of ski 10 passes thereby. Rollers 64 and 68 act as spacing and locating guides to maintain electrodes 48 generally adjacent to the lateral sides of the metal edges of ski 10. As the tail of ski 10 passes between guide rollers 66 and 70, these rollers function similarly to rollers 64 and 68.

It will be understood that longitudinally spaced pairs of guide rollers are necessary to carry out the locating function for the electrode carrying heads due to the side cut of ski 10. It is well known that the side edges of skis are contoured to facilitate turning of the ski while skiing. Thus, the width of ski 10 varies along its length and thus, at times, one or the other of pairs of guide rollers 64 and 68 and 70 will be out of contact with the ski edge. In such situations, the spacing of the electrode carrying head from the ski edges will be maintained by the rollers on the heads which remains in contact. Guide rollers 64, 66, 68 and 70 are formed of an electrically conductive material and are all electrically grounded by means of conventional brushes 65 (FIG. 3) mounted adjacent thereto and maintained in contact therewith. In one embodiment, brushes 65 are commonly connected by wires 67 to the negative terminals of the power supplies which energize the electrodes as will be discussed in detail hereafter. Consequently, these rollers act as a ground for the metal ski edge with which a pair of the rollers is always in contact. As will also be duscussed more fully hereafter, each of the electrodes 48 is connected to the positive terminal of one of the power supplies so that it is electrically charged to a higher electric potential than the rollers. Consequently an electrical discharge from the electrodes to the metal ski edge will occur under proper spacing and charge conditions.

As best shown in FIG. 6, electrode assemblies 48 include ball bearings 72 mounted on rotatably driven shafts 74. Assembly 48 includes a first electrically nonconductive portion 76 interconnected by fasteners 77 to a second lower portion 78 which is mounted on ball bearing 72 to ride freely on rotating drive shaft 74. Nonconductive elements 76 support shafts 79 on which each of the treating electrodes 80 are mounted. Brushes 81 (FIG. 6) are shown in contact with each of the treating electrodes 80 to impart an electrical charge thereto. The brushes are electrically interconnected to a charging system described hereafter, which is capable of rapidly recharging the treating electrodes after an electrical arc discharge to the metal ski edge occurs. The mounting of the treating electrode 80 on electrically insulated portion 76 prevents grounding of the charged electrode through support and drive shaft 74 which would prevent the electrical arc discharge to the ski edge from occurring.

In the preferred embodiment, electrode 80 is formed of tungsten carbide in the shape of a wheel. It has been found that commercially available tungsten carbide cutting wheels identified as RNMG-106E and sold ty TRW, Inc. are satisfactory for use in the present invention, although other tungsten carbide elements of differing formulation or hardness, or even other suitable hard, conductive materials may also be used in this invention. As stated above, electrode 80 is mounted for rotation on shaft 79 which extends laterally outwardly from nonconductive support member 76. Shaft 79 mounts a sheave 84 on its opposite end. Sheave 84 is driven by means of a nonelectrically conductive O-ring drive belt 86 to sheave 88 which is fixedly mounted upon rotating drive shaft 74. In this way, the rotation of drive shaft 74 is transmitted to rotating electrode wheel 80. Compression spring members 90 are mounted between carrying heads 52 and 54 and electrode assemblies 48 to bias the electrodes toward the metal ski edge with a necessarily very light pressure.

Referring particularly to FIGS. 5 and 6, the rotational drive arrangement for electrodes 80 is shown to include a sheave 92 mounted on the distal end of shaft 74. Sheave 92 is adapted to cooperate with belt 94 which runs around a second larger sheave 96 mounted on shaft 98. Also mounted on shaft 98 is a smaller sheave 100 on which belt 102 runs. Belt 102 runs to a drive pulley associated with a conventional electric drive motor (not shown).

It will be understood that a separate drive motor may be associated with each electrode drive chain for rotational powering of the electrodes 80 on carrying heads 52 and 54 or that a single larger motor may be used. In the preferred embodiment, a pair of ¼ hp motors driving head pulleys at approximately 3450 rpm has been found satisfactory. Through the arrangement of larger-to-smaller sheaves described above, electrode 80 is driven at approximately 14,000 rpm. The rapid rotation of treating electrode 80 distributes the point of electrical arc origination about the surface of the electrode and, thus, portions of the entire surface of the electrode are uniformly torn away and deposited on the metal ski edge.

Figure 7:
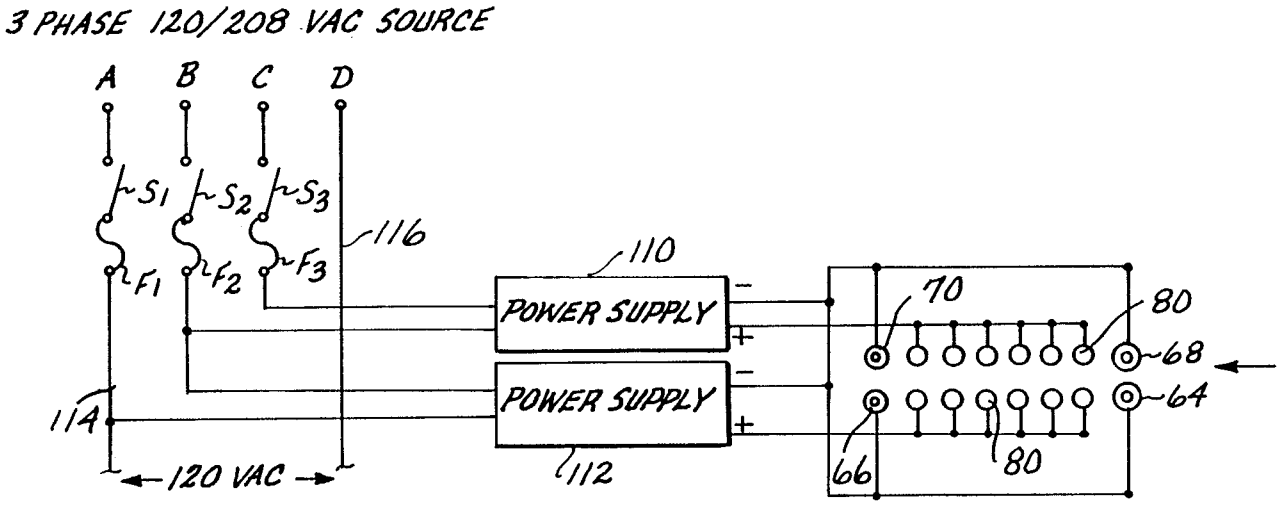
FIG. 7 is a diagram of the electrical subsystem for charging the electrodes; and, FIG. 8 is a diagram of the motor control and timing circuitry of the present invention.

Referring now to FIG. 7, the electrical subsystem for charging the electrodes 80 includes a pair of regulated power supplies 110 and 112, which are each connected to receive 208 volts AC from a conventional three-phase source. In particular, power supply 110 is connected to terminals B and C of the source through switches S2 and S3, respectively, and fuses F2 and F3, respectively. Power supply 112 is connected to terminals A and B of the source through switches S1 and S2, respectively, and fuses F1 and F2, respectively. As discussed hereinafter, conductors 114 and 116 connect terminal A and a neutral terminal N of the source to the motor control and timing circuitry shown in FIG. 8.

Referring again to FIG. 7, the power supplies 110 and 112 are of conventional design, producing a variable DC output that can be adjustably limited, both as to current and voltage. A suitable power supply is Model LT802, manufactured by Lamda Electronics, which has a rated output of Zero to 18 volts and 70 amps. The power supplies are arranged so that each of them charges one of the two sets of electrodes 80 carried by the electrode-carrying heads 52 and 54. To provide a potential across the gap between the electrodes and the metal ski edge, the electrodes 80 are connected to the positive terminals of the power supplies 110 and 112 and the two pairs of guide rollers 64, 66 and 68, 70 are connected to the negative terminals of the two power supplies through brushes 65 (not shown in FIG. 7). The negative terminals of the two power supplies are interconnected to form a negative ground for each of the four guide rollers. In operation, the power supplies continuously impress a potential upon each of the electrodes 80. A current path from an electrode back to its associated power supply is provided whenever the potential is sufficient to break down the gap or when the electrode contacts the metal ski edge. Since the power supplies are current and voltage limiting, they are not adversely affected by the surges created by the action of the electrodes. The capacity of the two power supplies and the operational arcing of the electrodes is such that the power supplies are substantially constantly loaded. Consequently, whenever discharged, the electrodes are rapidly recharged.

It will be understood that the charge on each of the rotating electrodes 80 is approximately 18 volts at 30–60 amps current, and that these electrodes continuously and rapidly move toward and away from the metal ski edge. Carrying members 48 are biased toward the ski by spring 90 and when the rotating electrode wheel 80 either discharges by sending an arc to the ski edge or contacts the metal ski edge, or both, the carrying member 78 is driven away from the ski edge in reaction and then again biased by spring 90 back toward the ski edge. This repeated to-and-fro movement repeatedly places the spinning electrode at a distance from the ski edge where an electrical discharge in the form of an electrical arc occurs. In one embodiment, it has been found that with a charge of aproximately 18 volts at 30–60 amps on the electrode, arcing will occur when the electrode is at a distance of approximately 0.005 to 0.01 from the ski edge. This electrical arcing may occur when the spinning electrode is moving toward or away from the ski edge.

As stated earlier, guide rollers 64, 66, 68 and 70 maintain the metal ski edge in a grounded or low electrical potential condition such that the travel of the electrical arc from electrode 80 is always in the direction toward the metal ski edge. It has been found that during arcing, a portion of the electrode 80 is removed from the electrode and transmitted toward and deposited upon the metal ski edge. In this manner, a coating of the material of which the electrode is made is deposited upon the metal ski edge. As discussed heretofore, and as illustrated in FIG. 5, the removal of the camber from the ski by means of downhold rollers 42, 44 and 46 maintains the metal ski edge in a fixed lateral position with respect to electrodes 80 thus allowing the arc from the rotating metal electrodes to contact the metal ski edge adjacent the lower portion of the lateral surface thereof thus producing a coating of hard material adjacent ski edge corner 18.

In a preferred embodiment, electrodes 80 are formed of tungsten carbide and hard carbide material and is thus deposited in a very thin layer upon the lateral surface of the metal ski edge. Electrode wheels 80 are rotated on shaft 79 in a downward direction with respect to the metal ski edge and it has been found that rotation in this direction prevents deposition of electrode material upon the bottom or running surface of the ski edge.

In the preferred embodiment, a thin layer of hard carbide material is deposited on the lateral side of the metal ski edges from shortly behind the shovel of the ski to near the tail of the ski. It will be understood, however, that control of the charging of the electrode, for example, would allow only smaller or spaced portions of the ski edges to be coated.

It has been found that the use of six rotating electrodes on each side of the metal ski edge and operating in the manner described above, produces a satisfactory coating upon a ski moved past the electrodes at a speed of 49.5 feet per minute. It will be understood that increasing or reducing the number of electrodes, the speed of the ski or the charge on the electrodes will produce other satisfactory embodiments of an apparatus suitable for carrying out the method of the present invention.

Figure 8:
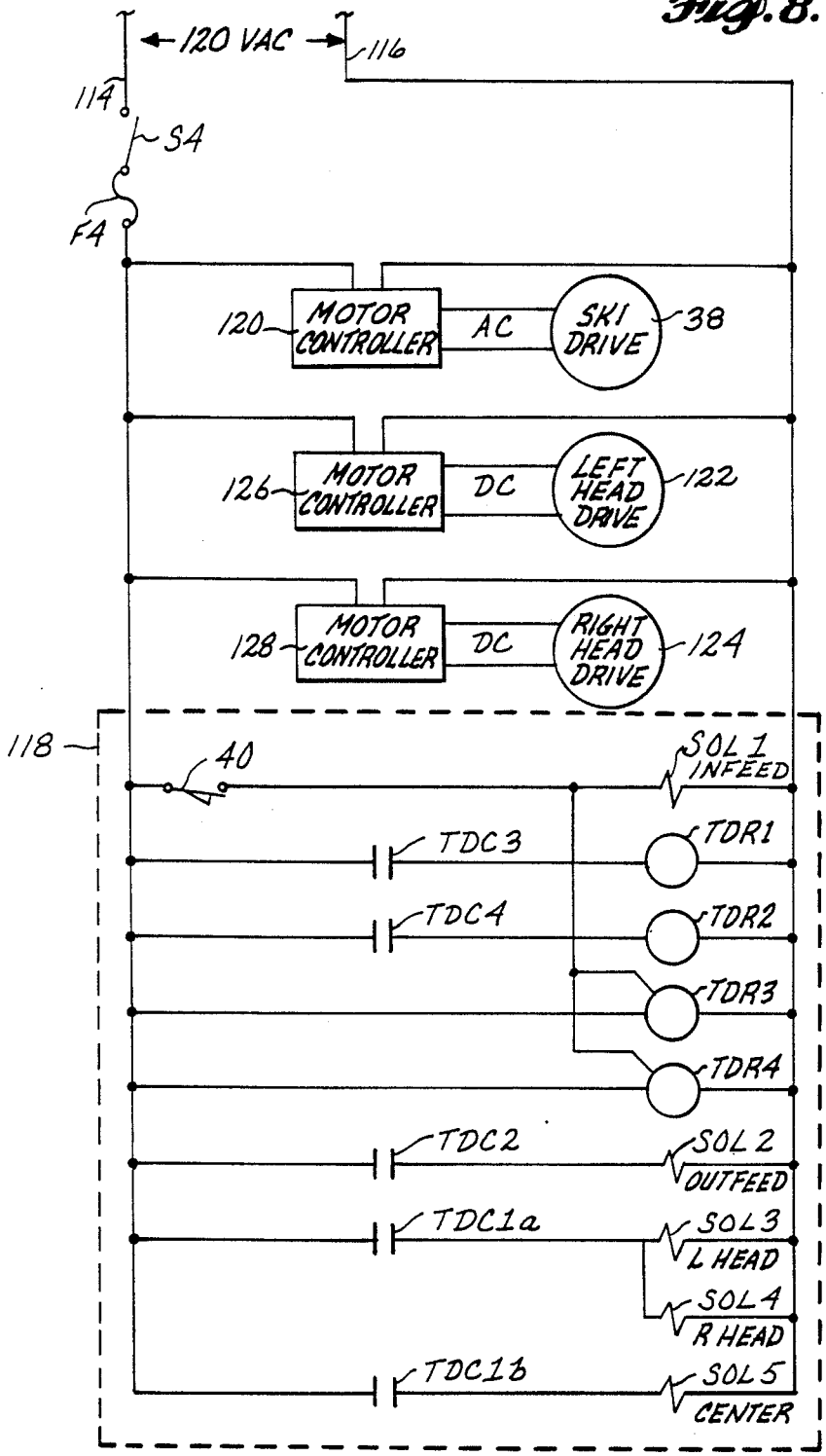

Referring now to FIG. 8, the 120 volts AC supplied from the source shown in FIG. 7 is coupled through a switch S4 and fuse F4 to three independent motor drive systems and a timing circuit 118. A conventional motor controller 120 provides AC power to, and regulates the speed of, the ski conveyor drive motor 38. Each of the two sets of electrodes 80 is rotationally driven by a separate DC drive motor. In FIG. 8, these motors are designated "left head drive" 122 that drives the electrodes carried by carrying head 52, and "right head drive" 124 that rotates the electrodes carried by carrying head 54. Left head drive motor 122 is powered and speed regulated by a conventional DC motor controller 126 and right head drive motor is powered and speed regulated by a conventional DC motor controller 128. The Ratio-Pax, RP-1 motor controller manufactured by Boston Gear International, Inc., is suitable for use for each of the motor controllers 126 and 128.

The timing circuit 118 establishes the timing sequences that activate the pneumatic cylinders that control the upward and downward movement of downhold rollers 42, 44, and 46 and the inward and outward movement of the electrode-carrying heads 52 and 54. The "engage" and "disengage" timing sequences are activated by the movement of the ski 10 over limit switch 40. For the "engage" sequence, the movement of the tail of the ski over limit switch 40 energizes solenoid SOL1 and time delay relays TDR3 and TDR4. Solenoid SOL1 is an integral part of pneumatic cylinder 42a which, when energized, actuates this cylinder to drive the infeed downhold roller 42 into engagement with the ski. Time delay relays TDR3 and TDR4 are of the opening, or off, type and control the closing and opening of contacts TDC3 and TDC4. When time delay relays TDR3 and TDR4 are energized upon tripping of the switch 40, contacts TDC3 and TDC4 are immediately closed and remain closed for the time duration established by their associated time delay relays. The effect of this operation is to energize two other time delay relays, TDR1 and TDR2, for the time interval determined by relays TDR3 and TDR4, respectively.

Time delay relays TDR1 and TDR2 are of the time delay closing, or on, type and function to control the opening and closing of electrical contacts TDC1a and TDC1b (both controlled by TDR1) and TDC2 (controlled by TDR2). In operation, the contacts TDC1a and TDC1b close after a time delay period established by relay TDR1. This delay period begins upon energization of relay TDR1 by the closure of contact TDC3. Time delay relay TDR2 functions in a similar manner to close contact TDC2 after a time delay period that begins upon closure of contact TDC4. Since contacts TDC3 and TDC4 close immediately upon closure of the limiting switch 40, the overall effect is to have contacts TDC1a, TDC1b, and TDC2 close at timed intervals relative to the activation of switch 40. The closing times are selected so that the simultaneous closure of contacts TDC1a and TDC1b occur prior to the closure of contacts TDC2, i.e., time delay relay TDR2 has a longer delay than time delay relay TDR1.

As shown in FIG. 8, closure of contact TDC1b connects solenoid SOL5 with the power source. This solenoid is an integral part of pneumatic cylinder 44a, which controls the movement of the outer downhold roller 44. When actuated by the energization of solenoid SOL5, cylinder 44a drives the center downhold roller 44 into engagement with the ski. The closure of contact TDC1a energizes solenoids SOL3 and SOL4 that control actuation of the cylinders and pistons 50 and 62, respectively, which control movement of the left electrode-carrying head 52 and the right electrode-carrying head 54, respectively. It will thus be seen that the three solenoids SOL3, SOL4, and SOL5, are simultaneously energized upon expiration of the time delay set by time delay TDR1. The operational effect is to have the two electrode-carrying heads 52 and 54 and the center downhold roller 44 synchronously moved into engagement with the ski. It will be appreciated that the time when this occurs, as set by the relay TDR1, is selected in accordance with the known speed of movement of the conveyor belts 30 so that engagement with the ski occurs at the appropriate time.

Solenoid SOL2 is an integral part of the pneumatic cylinder 46a that controls operation of the outfeed downhold roller 46. Since the period of delay set by relay TDR2 is longer than that set by relay TDR1, solenoid SOL2 is energized after the energization of solenoids SOL3, SOL4, and SOL5. Consequently, the outfeed downhold roller 46a is the last of the rollers to move into engagement with the ski. The timing of this engagement, as set by relay TDR2, is such that the downhold roller 46 contacts the tail of the ski as it passes therebeneath.

When the shovel of the ski 10 passes over the limit switch 40, it opens the same, initiating the "disengage" sequence that causes the downhold rollers 42, 44, and 46 to rise sequentially to release the ski and avoid contact with the shovel. The order of disengagement of the rollers is the same as the order of engagement, with the roller 42 being released first, roller 44 (and electrode-carrying heads 52 and 54) being released next, followed by release of the outfeed roller 46. Reference is again made to FIG. 8 for an understanding of this operation. When the shovel of the ski opens limit switch 40, SOL1 is deenergized, causing deactivation of pneumatic cylinder 42a and upward, disengaging movement of infeed downhold roller 42. The opening of switch 40 also deenergizes time delay relays TDR3 and TDR4. Since these two relays are of the time delay opening type, the contacts that they control (TDC3 and TDC4, respectively) remain closed until expiration of the preset periods of delay. The delay period for relay TDR3 expires first, opening contact TDC3 and thereby deenergizing relay TDR1. When this occurs, contacts TDC1a and TDC1b open without delay since TDR1 is of the time-opening type. As a result, solenoids SOL3, SOL4, and SOL5 are deenergized and the pneumatic cylinders controlled thereby actuated to cause disengagement of the left and right electrode-carrying heads 52 and 54 and the center downhold roller 44.

Thereafter, the longer delay period of relay TDR4 expires, opening contact TDC4 so as to deenergize time delay relay TDR2. Contact TDC2 opens immediately upon deenergization of relay TDR2, resulting in the deenergization of solenoid SOL2. Consequently, pneumatic cylinder 46a is deactivated, causing disengagement of the outfeed downhold roller 46.

It will thus be seen that movement of the tail of the ski over limit switch 40 initiates the "engage" timing sequence while movement of the shovel of the ski thereover, initiates the "disengage" timing sequence. The upward and downward movement of the infeed downhold roller 42 is controlled directly by the opening and closing of the switch 40, while upward and downward movement of the rollers 44 and 46 and the inward and outward movement of the electrode-carrying heads 52 and 54 are controlled by the timed sequencing of relays TDR1, TDR2, TDR3, and TDR4. In particular, relays TDR1 and TDR2 establish the timing sequence for the engagement of these components while relays TDR3 and TDR4 establish the timing sequence for disengagement of these components.

It will be understood that a wide variety of timing devices, such as digital timing circuits, can be substituted for the timing circuit 118 discussed above. It will also be appreciated that a number of arrangements other than the limit switch 40 can be employed to initiate the timing sequences that control movement of the rollers and electrode-carrying heads.

As will be apparent to those skilled in the art to which the invention is addressed, the present invention may be embodied in forms other than those specifically disclosed above without departing from the spirit or essential characteristics of the invention. The particular embodiment of the apparatus 28, described above, is therefore to be considered in all respects as being merely illustrative of a form of apparatus capable of carrying out the method of the present invention. Further, the particular steps of the treatment method disclosed are also to be considered in all respects as illustrative and not restrictive.

The scope of the present invention is as set forth in the appended claims, rather than in the foregoing description.

The embodiments of the invention in which an exclusive property or privilege is claimed are defined as follows:

1. A method of treating a ski having a top, bottom and side portions, said side portions having metal edges on their lower portions, said metal edges having side portions and bottom portions, said method comprising the steps of:

orienting and conveying the ski longitudinally along a path;

placing an electrode formed at least in part of carbide and with a circular external shape on at least one side of said path adjacent said metal edge;

rotating said electrode about an axis extending substantially longitudinally of the metal edge;

creating an electrical arc from said electrode to said metal ski edge to carry and deposit carbide from said electrode onto said metal edge; and, mounting said rotating electrode in position relative to said metal edge to deposit carbide from said electrode onto the side portion of said metal edge but not on the bottom portion of said metal edge.

2. The method of claim 1 wherein said ski remains stationary and said rotating electrode is passed along at least one side of said ski to create an electrical arc from said electrode to said metal ski edge.

3. The method of claim 1 including the step of placing electrodes on both sides of said path adjacent the metal edges on both lateral sides of said ski.

4. The method of claim 3 including the step of placing a plurality of electrodes at longitudinally spaced intervals along both sides of said path.

5. The method of claim 4 including the step of carrying carbide from said electrode to said metal ski edge by means of said electrical arc to deposit at least a partial coating of carbide on said metal ski edge.

6. The method of claim 5 including the step of causing said electrodes to move toward and away from said metal ski edge to repeatedly create electrical arcs.

7. The method of claim 3 including the steps of placing electrodes formed at least in part of carbide on both sides of said path and depositing carbide on said metal ski edges by carrying carbide from said electrodes to said metal edges along said electrical arcs.

8. The method of claim 7 wherein the electrode is in the shape of a wheel.

9. The method of claim 8, wherein said electrode is in the form of a solid wheel.

10. The method of claim 1, further comprising mounting said rotating electrode in position relative to said metal edge to permit said electrode to repel away from said metal ski edge in reaction to the discharge of the electrical arc from said electrode to said metal ski edge.

11. A method of depositing carbide on a metal edge of a snow ski having a top, a base, opposing curved sides and a metal edge on lower portions of said opposing curved sides, the metal edge having an exposed side corresponding to the side of the ski and an exposed bottom corresponding to the bottom of the ski, said method comprising the steps of:

conveying a ski along a path such that the metal edge of said ski moves past a rapidly rotating electrode spaced laterally adjacent thereto and formed at least in part of carbide;

holding said metal ski edge at a first level of electrical potential;

electrically charging said electrode to a second level of electrical potential, higher than said first level to cause an electrical arc to pass from said electrode to said metal ski edge; and, positioning the rotating electrode relative to the metal ski edge to convey and deposit carbide from said electrode onto the side of said metal ski edge by means of said electrical arc without conveying and depositing carbide from said electrode onto the bottom of said metal ski edge and without conveying and depositing carbide on the opposing curved sides of the ski not covered by the exposed side of the metal edge.

12. The method of claim 11 wherein said carbide is deposited on said ski edge in a melted condition

13. The method of claim 11 including the step of placing electrodes on both sides of said path.

14. The method of claim 11 including the steps of mounting said electrode on a carrying head which is movable laterally with respect to said ski and moving said carrying head and said electrode inwardly and outwardly responsive to the side curvature of said ski.

15. The method of claim 14 including the step of pivotally mounting said electrode on said carrying head and spring biasing said electrode toward said metal ski edge.

16. The method of claim 11 including the step of exerting vertical pressure on said ski adjacent said electrode to flatten said ski and position said ski edge with respect to said electrode when said electrical arc passes from said electrode to said metal ski edge.

17. The method of claim 11 wherein the electrode is formed in the shape of a wheel, and including the step of rotating said electrode about an axis generally parallel to the path of travel of said ski.

18. The method of claim 17, is a rigid member.

19. The method of claim 11 including the step of conveying said ski past an electrically-grounded guide member which contacts and grounds said metal ski edge.

20. The ski of claim 11 wherein the carbide deposit on said ski edge is less than 1 mil in thickness.

21. The method of claim 11, further comprising mounting the electrode relative to the ski path to permit the electrode to retract away from the metal edge of the ski in reaction to the discharge of the electrical arc from said electrode to said metal ski edge.

22. An apparatus for depositing material on a metal edge of a ski having a top surface, a bottom surface, a pair of opposed side surfaces and a metal edge having a lateral surface and a bottom surface on a lower portion of said opposed side surfaces comprising:

means conveying a ski having a metal edge along a longitudinal path;

charged electrode means positioned adjacent said path;

means for creating a voltage differential between said charged electrode means and a metal edge such that an electrical arc passes from said electrode means to said metal edge to carry and deposit material from said electrode means onto the metal edge of said ski; and, means for mounting said electrode means relative to the metal edge to cause the electric arc to carry and deposit material from said electrode means onto the lateral surface of the metal edge without depositing an appreciable amount of material from said electrode means onto the bottom surface of the metal edge of said ski.

23. The apparatus of claim 22 wherein said means for conveying a ski along a path includes an endless belt adapted to convey a ski oriented longitudinally thereon.

24. The apparatus of claim 22 including means structurally distinct from said electrode means adapted to exert downward pressure on the top surface of said ski to flatten and position and ski adjacent said electrode means during the disposition of material from said electrode onto the metal edge of said ski.

25. The apparatus of claim 24 wherein said ski is conveyed with its top surface up and said means for exerting downward pressure includes holddown rollers adapted to contact the top surface of said ski.

26. The apparatus of claim 22 wherein said electrode means includes an electrode formed at least in part of carbide.

27. The apparatus of claim 26, wherein said electrode is constructed as a solid member.

28. The apparatus of claim 22 wherein said electrode means includes at least one rotatable electrode member formed at least in part of carbide.

29. The apparatus of claim 22 wherein said means for creating a voltage differential between said electrode means and said metal ski edge includes means for electrically charging said electrode means to a first level of potential and means for holding said metal ski edge at a second lower level of potential.

30. The apparatus of claim 22 wherein said electrode means are formed of tungsten carbide such that the passage of said electrical arc from said electrode means to said metal ski edge carries tungsten carbide from said electrode means and deposits it in a melted condition on said metal ski edge.

31. The apparatus of claim 30, wherein said mounting means positioning said electrode means relative to the metal ski edge to cause the electrical arc to carry and deposit carbide material from the electrode primarily onto the lower portion of the lateral surface of said metal ski edge adjacent the bottom surface of the metal ski edge.

32. The apparatus of claim 22 wherein said electrode means includes a wheel-shaped member formed at least in part of carbide and adapted to be rotated with respect to said metal ski edge.

33. The apparatus of claim 32 wherein said electrode means includes a plurality of electrodes positioned adjacent both sides of said path.

34. The apparatus of claim 22, wherein said means for mounting said electrode means having means to enable said electrode means to move laterally relative to the metal edge responsive to the curvature of the ski.

35. The apparatus of claim 22, further comprising said mounting means positioning said electrode means spaced away from the metal edge of said ski.

36. A method of treating a ski having a top, bottom and side portions, said side portions having metal edges on their lower portions, said metal edges having side portions and bottom portions, said method comprising the steps of:

orienting and conveying the ski longitudinally along a path;

placing a plurality of electrodes formed at least in part of carbide at longitudinally spaced-apart intervals along both sides of the path adjacent the metal edges; and, creating an electrical arc from said electrode to the metal ski edge to carry and deposit at least a partial coating of carbide from the electrode onto the side portion of the metal edge but not on the bottom portion of the metal edge, with the carbide being concentrated on a lower side portion of the metal edge.

37. A method of treating a ski having a top, bottom and side portions, said side portions having metal edges on their lower portions, said metal edges having side portions and bottom portions, said method comprising the steps of:

orienting and conveying the ski longitudinally along a path;

placing electrodes formed at least in part of carbide and in the shape of a wheel on both sides of said path adjacent the metal edges on both lateral sides of said ski;

rotating said electrodes about an axis generally parallel to said path of travel of the ski and maintaining the electrodes spaced away from the metal ski edge; and, creating an electrical arc from said electrodes to said metal ski edges to carry carbide from said electrodes along the electrical arcs and deposit the carbide onto the side portions of said metal edges but not on the bottom portions of said metal edges.

38. A method of depositing carbide on a metal edge of a snow ski having a top, a base, opposing curved sides and a metal edge on the lower portions of said opposing curved sides, the metal edge having an exposed side corresponding to the side of the ski and an exposed bottom corresponding to the bottom of the ski, said method comprising the steps of:

conveying a ski along a path such that the metal edge of said ski moves past a rapidly rotating electrode spaced laterally adjacent thereto and formed at least in part of carbide;

holding said metal ski edge at a first level of electrical potential;

electrically charging said electrode to a second level of electrical potential, higher than said first level to cause an electrical arc to pass from said electrode to said metal ski edge; and, positioning the rotary electrode to convey and deposit carbide from said electrode onto the side of said metal ski edge by means of said electrical arc without conveying and depositing carbide from said electrode onto the bottom of said metal ski edge, and to concentrate the carbide on a lower portion of a side of the metal ski edge.

39. A method of depositing carbide on a metal edge of a snow ski having a top, a base, opposing curved sides and a metal edge on the lower portions of said opposing curved sides, the metal edge having an exposed side corresponding to the side of the ski and an exposed bottom corresponding to the bottom of the ski, said method comprising the steps of:

conveying a ski along a path such that the metal edge of said ski moves past a rapidly rotating electrode spaced laterally adjacent thereto and formed at least in part of carbide;

holding said metal ski edge at a first level of electrical potential;

electrically charging said electrode to a second level of electrical potential, higher than said first level to cause an electrical arc to pass from said electrode to said metal ski edge; and, positioning the electrode at a location spaced away from the metal ski edge to convey and deposit carbide from said electrode onto the side of said metal ski edge by means of said electrical arc without conveying and depositing carbide from said electrode onto the bottom of said metal ski edge.

40. A method of depositing carbide on a metal edge of a snow ski having a top, a base, opposing curved sides and a metal edge on the lower portions of said opposing curved sides, the metal edge having an exposed side corresponding to the side of the ski and an exposed bottom corresponding to the bottom of the ski, said method comprising the steps of:

conveying a ski along a path such that the metal edge of said ski moves past a rapidly rotating electrode spaced laterally adjacent thereto and formed at least in part of carbide;

holding said metal ski edge at a first level of electrical potential;

electrically charging said electrode to a second level of electrical potential higher than said first level to cause an electrical arc to pass from said electrode to said metal ski edge;

pivotally mounting said electrode on a carrying head which is movable laterally with respect to said ski and moving said carrying head and said electrode inwardly and outwardly responsive to the curvature of said ski;

spring biasing said electrode toward said metal ski edge;

positioning the rotating electrode to convey and deposit carbide from said electrode onto the side of said metal ski edge by means of said electrical arc without conveying and depositing carbide from said electrode onto the bottom of said metal ski edge; and, maintaining said electrode spaced away from the metal ski edge while the carbide is being conveyed and deposited from said electrode onto the side of said metal ski edge.

41. An apparatus for depositing material on a metal edge of a ski having a top surface, a bottom surface, a pair of opposed side surfaces and a metal edge having a lateral surface and a bottom surface on a lower portion of said opposed side surfaces comprising:

means conveying a ski having a metal edge along a longitudinal path;

charged electrode means positioned adjacent said path;

means for creating a voltage differential between said charged electrode means and a metal edge such that an electrical arc passes from said electrode means to said metal edge to carry and deposit material from said electrode means onto the metal edge of said ski;

wherein said electrode means are configured and positioned relative to the metal edge to cause the electric arc to carry and deposit material from said electrode means onto the lateral surface of the metal edge without depositing material from said electrode means onto the bottom surface of the metal edge of said ski; and, means for mounting said electrode means to enable said electrode means to move laterally relative to the metal edge responsive to the curvature of the ski, wherein said mounting means comprises biasing means for resiliently biasing said electrode means in the direction toward the metal edge to place said electrode means in close enough proximity to the metal edge to cause an electric arc to pass from said electrode means to the metal edge to deposit carbide material from said electrode means onto the lateral surface of the metal edge and to permit said electrode means to retract away from the metal edge in reaction to the discharge of the electrical arc from said electrode means to the metal edge.

* * * * *

UNITED STATES PATENT AND TRADEMARK OFFICE

CERTIFICATE OF CORRECTION

PATENT NO. : 4,818,839

DATED : April 4, 1989

INVENTOR(S) : William P. Chastain

It is certified that error appears in the above-identified patent and that said Letters Patent is hereby corrected as shown below:

Column 13, Claim 18: After "Claim 17," insert --wherein the electrode--.

Signed and Sealed this

Thirtieth Day of April, 1991

*Attest:*

HARRY F. MANBECK, JR.

*Attesting Officer*

*Commissioner of Patents and Trademarks*